US007359629B2

(12) United States Patent
Butler et al.

(10) Patent No.: US 7,359,629 B2
(45) Date of Patent: Apr. 15, 2008

(54) MOLDING COMPOUNDS FOR USE IN FURNACE BLOWER HOUSINGS AND BLOWER HOUSINGS MOLDED FROM THESE COMPOUNDS

(75) Inventors: Kurt I. Butler, Kingsville, OH (US); Steven T. Searl, Ashtabula, OH (US)

(73) Assignee: Premix Inc., North Kingsville, OH (US)

( * ) Notice: Subject to any disclaimer, the term of this patent is extended or adjusted under 35 U.S.C. 154(b) by 276 days.

(21) Appl. No.: 11/114,833

(22) Filed: Apr. 26, 2005

(65) Prior Publication Data

US 2006/0193722 A1 Aug. 31, 2006

Related U.S. Application Data

(60) Provisional application No. 60/656,582, filed on Feb. 25, 2005.

(51) Int. Cl.
*F24H 3/06* (2006.01)
*H05B 6/10* (2006.01)

(52) U.S. Cl. ..... 392/356; 219/634

(58) Field of Classification Search ..... 219/634, 219/730, 754; 118/724, 725, 723; *H05B 6/00, H05B 6/10*

See application file for complete search history.

(56) References Cited

U.S. PATENT DOCUMENTS 4,355,222 A * 10/1982 Geithman et al. ..... 219/633

(Continued)

OTHER PUBLICATIONS

The Society of the Plastics Industry, Inc.; FRP in Major Appliances—Premix-A Versatile Engineering Tool in Design Application, by C.G. Nenadal Section 15-C, p. 1-6. 31st Annual Technical Conference, 1976 Reinforced Plastics/Composites Institute The Society of the Plastics Industry, Inc, Appliances Designed With Fiberglass Reinforced Plastics by Jack Cross and C.G. Nenadal, Section 1-E, p. 1-3. Fiberglas/Plastics in Room Air Conditioners, Pub. No. 5-EA-5817, Aug. 1972, Litho in USA. 24th Annual Technical Conference, 1969 Reinforced Plastics/Composites Division The Society of the Plastics Industry, Inc.; The Evolution of Design with Premix in Applicance and Equipment, By C. G. Nenadal, Section 20-B, p. 1-6 . . . Fiberglas/Plastics in Room Air Conditioners, Pub. No. 5-EA-5122, Jan. 1971; Litho in USA. Fiberglas/Plastics in Recreational Vehicle Air Conditioning, Pub. No. 5-EA-5212, Jan. 1971, Litho in USA.

*Primary Examiner*—Daniel Robinson
(74) *Attorney, Agent, or Firm*—Hudak, Shunk & Farine Co. LPA

(57) ABSTRACT

The invention provides blower housings for air handlers and hot air furnaces which are made from molding compounds that allow for wide flexibility in molding complex configurations so as to improve blower efficiency, which improve manufacturing efficiency and safety and provide suitable mechanical properties, safety in use, and sound dampening. These compounds are generally liquid thermosetting molding resins which comprise a thermoset resin matrix such as a isophthalate polyester having a specific loading of glass reinforcing fibers. The compositions also include flame retardant additives. They are further formulated to meet the desired molding characteristics; to withstand the operating temperatures to which they will be exposed; and to have a predetermined strength and a desirable user interface including appearance, and odor. Typically, the compounds will have a glass transition temperature from about 160° C. (320° F.) to about 185° C. (365° F.).

4 Claims, 3 Drawing Sheets

U.S. PATENT DOCUMENTS 6,399,206 B1 * 6/2002 Carswell et al. ..... 428/423.1
6,451,956 B2 * 9/2002 Sorriero et al. ..... 528/170
6,712,989 B1 * 3/2004 Awakura et al. ..... 252/62.51 R
6,936,794 B2 * 8/2005 Zhang et al. ..... 219/400
6,940,051 B2 * 9/2005 Tateishi ..... 219/508
7,170,038 B2 * 1/2007 Butler ..... 219/634
7,176,420 B2 * 2/2007 Abbott et al. ..... 219/543
2005/0139594 A1 * 6/2005 Jones et al. ..... 219/687

* cited by examiner

MOLDING COMPOUNDS FOR USE IN FURNACE BLOWER HOUSINGS AND BLOWER HOUSINGS MOLDED FROM THESE COMPOUNDS

This application is based on U.S. Provisional Application Ser. No. 60/656,582, filed on Feb. 25, 2005

FIELD OF INVENTION

The field of invention is molding compounds that are particularly suitable to be molded into a blower housing for use in hot air handlers, hot air furnaces and other HVAC applications. These compounds are generally liquid thermosetting molding resins typically characterized as bulk molding compositions ("BMC"), sheet molding compositions ("SMC"), and/or thick molding compositions ("TMC"). They can be used in molding processes such as compression, transfer, injection/compression molding and injection molding.

Products molded from the composition of this invention desirably have adequate glass transition temperatures, flame retardance, and desirable surface characteristics; high and low temperature stability, corrosion and shrink resistance; low odor, sound damping strength; and cost. Desirably the compositions include a thermoset resin matrix such as a isophthalatic polyester resin which can include blends of polyester and/or vinyl ester with additives for flame retardancy, and for mechanical properties and sound dampening typically glass fiber, and optionally carbon black or other fillers. They are further formulated to meet the desired molding characteristics; to withstand the operating temperatures to which they will be exposed; and to have a predetermined strength and a desirable user interface including appearance, and low odor. These products can be molded in complex geometries for part consolidation while maintaining desirable material characteristics. For example, the products may include mounting brackets for motors and thus need to be self-supporting as well as supporting other components over a broad range of temperatures. Moreover, the product geometries may include sharp angles; projections, recesses, ribs groves, surface texturing, as well as fluid curving shapes of varying cross-sectional thicknesses for fluid dynamics or sound attenuation. Typically, the compounds will have a glass transition temperature from about 160° C. (320° F.) to about 173° C. (343° F.).

The molding compositions in accordance with the invention can be formed into articles having complex configurations to improve heating and fabrication efficiency, including configurations with fluid curving lines and further which include integrally molded functional elements, such as rims, flanges, bosses, male and female mating parts. This streamlines, and may eliminate dangerous and therefore costly fabrication steps, such as cutting and welding sheet metal. Moreover, the compositions can be easily molded based on computer generated models. This task might be impossible, if not very expensive for metal. These articles can be relatively large and have the mechanical strength, even at elevated temperatures (typically the heater in a residential furnace may operate at temperatures around 100° F.), to be self-supporting and to support other elements such as the blower motor. The invention thus also relates to the molded blower housings which can be used in air handlers and hot air furnaces for residential and commercial buildings.

BACKGROUND OF THE INVENTION

Reliance on external sources of energy is a continuing source of national concern. Accordingly, the government has mandated that manufacturers improve the efficiency of their air handlers. To this end, the government through the Department of Energy recently supported a two year study by GE Global Research (DOE Award DE FC26-000T40993, and principal author, Herman Wiegman), with the goal of improving the efficiency of furnace blowers. This project known as the "Advanced Blower Project" had a total spending budget of 3.2 million dollars. One of the issues studied involved air flow control through the blower housing.

Traditionally, blower housings for residential and commercial air handlers and hot air furnaces have been fabricated from sheet metal, and involve a design that has changed very little over the past several decades. The shape involves a modified cylinder having curving walls attached to planar front and back walls. The blower motor is mounted with its central axis along the central axis of the cylinder. The cylinder opens into an air exhaust shaped like a rectangular bell from a French horn and which includes an elongated channel that extends across the length of the cylinder parallel to the central axis. This design involves curving right angle edges that require considerable bending and welding during fabrication of the sheet metal. This leads to the possibility of injury to workers who are exposed to sharp edges, and extreme heat in welding. In addition, there are often functional features such as mounting flanges and clamps that need to be individually worked and/or attached to the blower housing. The final assembly of the blower requires intensive labor and puts the assembly worker at risk of injury through cuts or burns. This adds considerable expense to the fabrication of the housing.

Despite the manufacturing difficulties that metal presents, it has always been the material accepted by the industry for this component because of the environment that the blower encounters during use. The blower is generally located at the bottom of the furnace, below the heater, or in the central section of an air heater which could include a series of heating coils that may reach temperatures of about 1,000° F. While there is often a partition and insulation between the blower and the heater, the temperatures to which the blower housing are subjected can be quite high. In particular this is true for some spots, such as at the air exhaust. In addition to the stress of elevated temperatures, the environment can be corrosive, and as some furnaces are located outside residences, they can also be subjected to cold temperatures. The blower housing also needs to have sufficiently high mechanical properties, since one of the industry tests is a drop test in which the furnace is dropped, and the blower housing must survive intact. Finally, the blower housing tunnels relatively large volumes of air. It may run continuously in cold weather, and is housed in a furnace cabinet that is often a large sheet metal box that can actually act to amplify the sound, if not sufficiently dampened for sound transmission. An example of a furnace set up is shown in U.S. Pat. No. 5,375,586 to Schumacher et al., while an example of an improvement in blower housings is shown in U.S. Pat. No. 6,324,894 to Gatley, Jr.

Molded polymeric housings present many advantages over the prior art metal housings. They significantly reduce the potential for injury during assembly by eliminating the need for high temperature welding operations, and for cutting and bending sheet metal. They greatly increase the efficiency of assembly by providing the opportunity for integrally molded functional elements, such as mating clamps and mounting flanges. Thus, molded polymeric housings have been in use for a significant period of time for blowers for air conditioners, and in particular room air conditioners. In addition, they have been used for small scale heating blowers subjected to relatively low temperatures, such as hair dryers. These applications often involve the use of very expensive compositions, which can be used since the size is small. Other hot air furnace components, such as the condensate pan, have been made of molded resins for some time.

However, despite the use of molded polymerics for these other applications and for housings in window air conditioners for well over 30 years, the HVAC industry has failed to capitalize on the many advantages which could be realized through the use of molded polymeric blower housings for hot air furnaces. There are several reasons to account for the prior art practice, including the belief that the blower environment is better suited for metal, which has proven longevity and fire resistance. An additional problem is the lack of understanding in the compounding industry of how to achieve sufficient structural reinforcement, such as through the use of glass fiber reinforcement, while maintaining proper sound dampening properties for this application.

The present invention provides the solution to the previously mentioned issues, while also presenting a platform for improved air flow efficiencies. The present invention provides a molded composite compound blower housing for hot air furnaces. This blower housing includes integral molded functional parts, such as mating clamps, and mounting flanges. It has the desired mechanical properties including tensile and impact properties at the necessary operating temperature range. It can be molded into complex curving configurations and surface characteristics derived by computer modeled images to maximize flow conditions. It does this while maintaining quiet and safe operating conditions.

SUMMARY OF THE INVENTION

The present invention provides hot air furnace/air handler blower housings which are molded from compositions that meet the molding, safety, strength, and aesthetic requirements for this use. These compounds are typically liquid thermoset resins with a specific level of reinforcement additives to achieve the desired sound dampening for this article. Additional additives include initiators, flame retardants, and molding agents to permit the compositions to be molded into the desired shape by a variety of types of molding processes. Optimally, the base resin can include a polyester resin and more specifically can be an isophthalate polyester having a loading of glass fibers of from about 10 to about 25%, and more desirably for sound dampening from about 15 to about 20%, and in particular for sound dampening about 17% to 19% (with a desired percentage of 20-35% for some structural applications by weight loading of glass fibers, these percentages being based on the total weight of the composition.

In particular, the formulations involve the use of a resin matrix with significant loadings of glass filler; various additional additives, such as flame retardants, sound dampeners, initiators, inhibitors, mold-release agents, shrink control additives, viscosity agents, flow modifiers, thickeners, styrene, and carbon black or pigments or other desirable additives.

The foregoing improvements in specimens molded from these compositions enable the low cost mass production of blowers used in hot air furnaces/air handlers, and further allow for the far greater flexibility in blower housing design in order to meet the mandate of improved unit efficiency and also permit the combination of functions in a single article so as to permit greater fabrication efficiency and lower cost.

DETAILED DESCRIPTION OF THE INVENTION

The invention relates to improvements to blower housings used in air handlers and hot air furnaces and in particular made from molding resins. In particular, the resins can be used in injection molding processes, in transfer molding processes, in compression molding processes, and in injection/compression molding processes to make the blower housing. These processes are cost effective because they eliminate labor intensive machining and fabrication. The processes further have better ability to control shot to shot cross parting line thickness. Further these molding processes enable the production of complex configurations that have integral functional features and that have significant concentrations of fillers including fiber reinforcement and flame retardants.

Figure 1:
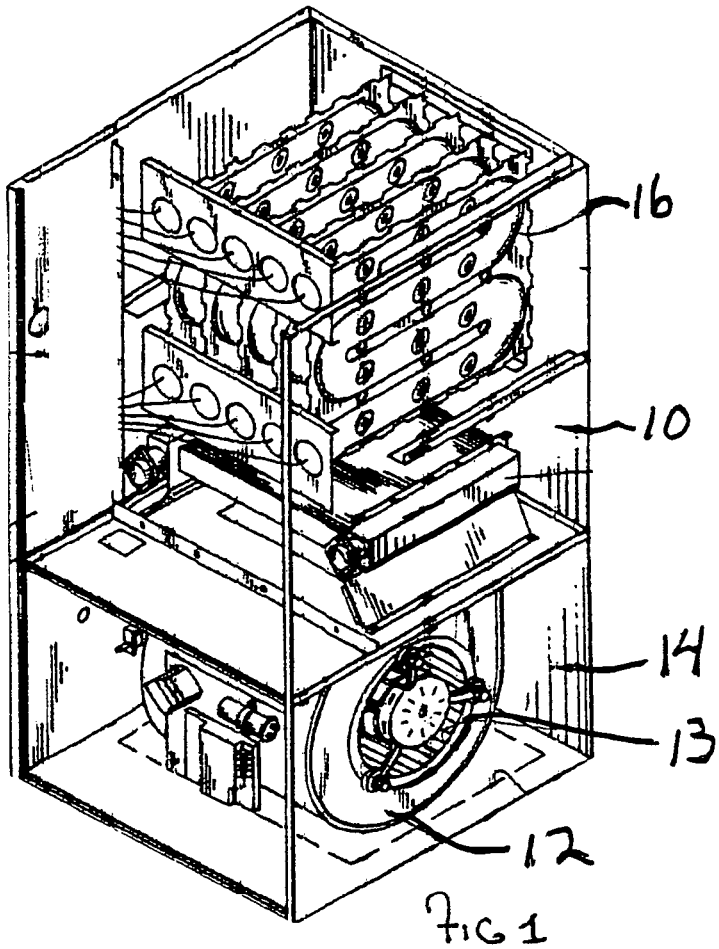
FIG. 1 is an illustration of a furnace incorporating a blower housing in accordance with the present invention.
Figure 2:
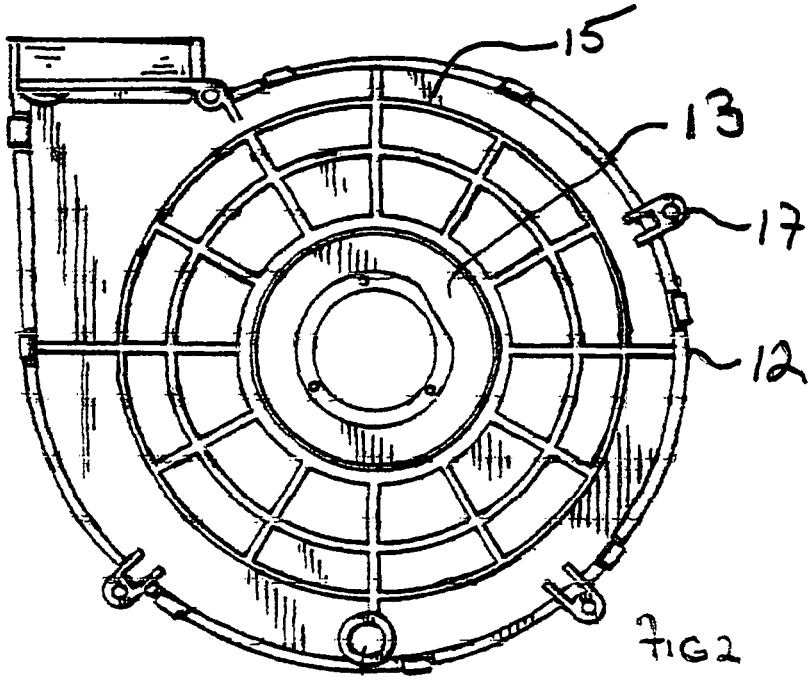
FIG. 2 is an illustration of the blower housing of FIG. 1.

FIG. 1 shows a typical hot air furnace 10 of the prior art. This furnace includes the blower 13 is mounted within a housing 12 that supports the blower motor, and directs the air in the furnace cabinet 14. The air is directed over the heating coils 16 that can reach temperatures up to about 1,000° F. FIG. 2 shows a side view of the blower housing 12 which is shown as including the motor 13 and various integral mounting features, such as reinforcing ribs 15, and mounting flanges 17.

Sheet molding and bulk molding compositions are described in U.S. Pat. Nos. 5,998,510; 5,342,554; 5,854,317; 5,744,816; and 5,268,400; all of which are hereby incorporated by reference for their teachings on the various modifications to molding compositions that are known to the art.

One component of the molding resin composition is a cross linkable prepolymer such as an unsaturated polyester resin or vinyl ester resin. Desirably the prepolymer has a relatively low molecular weight such as from about 200 to about 5000 (weight average) and a glass transition temperature from about 160° C. (320° F.) to about 173° C. (343° F.). They are described in detail with examples in the above patents incorporated by reference. The polyester resins are the condensation product derived from the condensation of unsaturated polybasic acids and/or anhydrides with polyols such as dihydroxy or trihydroxy compounds. Desirably, these polyester resins are the esterification reaction product of diacids, or anhydrides of diacids, generally having from about 3 to about 12, or more preferably from about 4 to about 8 carbon atoms, with a polyol or a cyclic ether having from about 2 to about 12, or more preferably from about 2 to about 6 carbon atoms.

In general, the vinyl ester resins that can be used are the reaction products of epoxy resins and a monofunctional ethlenically unsaturated carboxylic acid. More specifically, these vinyl ester resins are the reaction product of an epoxy terminated oligomer, for example, an epoxy functionalized bisphenol A with an acrylic acid, or methacrylic acid forming acrylic terminal groups on the oligomer. The vinyl esters have predominantly terminal unsaturation while the unsaturated polyesters have predominantly internal unsaturation.

Another component of the molding composition is one or more unsaturated monomer that is copolymerizable with the resin. Desirably, this component is capable of dissolving the resin component at room temperature. Thus, in one embodiment the resin is dissolved in the monomeric component prior to being combined with the remaining components. Examples of suitable monomers are styrene, alpha-methyl styrene, chloro-styrene, vinyl toluene, divinyl benzene, diallylphthalate, methyl methacrylate, and mixture of these, with preferred monomers being styrene and methyl methacrylate. The ratio of monomer(s) to resin is desirably from about 5:95 to about 50:50 and preferably from about 10:90 to about 25:75 by weight.

Figure 3:
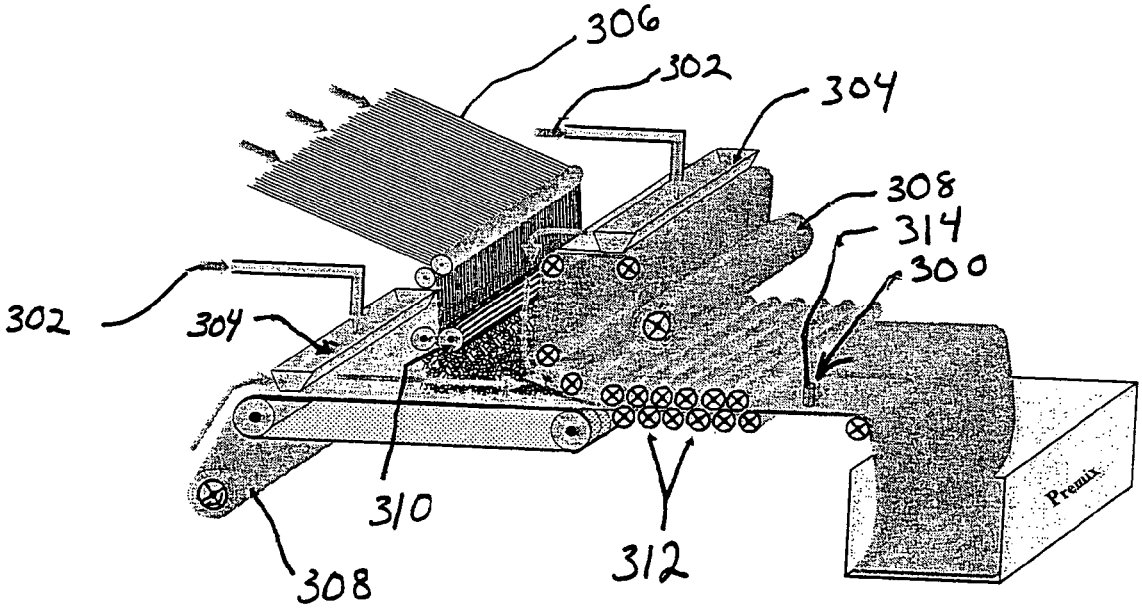
FIG. 3 is an illustration of an SMC Machine showing the compounding of glass with the resin carrier of the present invention.

Another component to the molding composition is fillers. In accordance with the invention the predominant filler is a reinforcing filler in order to impart structural properties and sound dampening to the final molded product. A preferred filler is glass fibers and fibrous reinforcing agents such as cotton glass fibers or graphite microfibers; The fibers may comprise chopped sized glass microfiber rovings at an amount below 25% for sound dampening, and preferably from about 10 to about 22%, and more preferably from about 15 to about 22%, and most preferably about 18% in particular for the blower housing. The fibers are from about ⅛ to about 12 inch for BMC, to about ¼ to about 2 inches for SMC, and from about ¼ to about 1 inch for TMC. FIG. 3 is a graph of the sound speed versus temperature for a resin composition testing various loadings of glass fibers and correspondingly decreased loadings of another filler, $BaSO_4$.

An initiator is another component of the molding composition. The initiator initiates the copolymerization of the resin and the monomer(s). Initiators include any free radical initiator capable of forming radicals in the correct concentration under the molding conditions. They may include peroxides, hydroperoxides, redox systems, diazo compounds, persulfates, perbenzoates etc. The initiators are typically used in amounts of about 0.05 to about 5 weight percent, and more preferably about 0.1 to about 2 weight percent. Alternatively, these amount can be expressed in parts per hundred parts by weight of resin, i.e. from about 0.5 to about 4.0 phr, preferably from about 0.7 to about 3.0 phr, and most preferably from about 0.8 to about 2.25 phr. Alternatively high temperature initiators such as Di-cup, e.g. dicumyl peroxide can be used for molding applications where higher initiation temperatures are desirable. Peroxy Ester and Perketal initiators are preferred.

The inclusion of 0.5 to 10 phr, preferably about 1 to 8 phr, of a mold release agent, such as Tech-lube HV706, calcium stearate, zinc stearate, or the like may also be of advantage to achieving without machining the complex molded part of the present invention. Tech-lube HV706 is proprietary composition of fatty acids, glycerides, polymeric resin and phosphate surfactant sold by Tech-nick Products of New Jersey. A viscosity reducer can be used in combination with styrene to maintain the molding properties, and the decrease the cost of the composition.

Another optional component to the improved molding composition is a rheological modifier, which may act to increase the molecular weight such as by chain extension of the resin prepolymer. Suitable modifiers include Group II oxides and hydroxides, such as calcium or magnesium oxide. These modifiers may act to increase shear and thus promote flow and glass carry in the composition during molding. Fumed silica is an example of a substance, which may act mechanically to increase molding viscosity and therefore also be a suitable rheological modifier either alone or in combination with the previously mentioned ingredients.

Desirably the rheological modifiers are used in an effective amount to enhance molding properties, such as thickening the resin system prior to molding. Desirable amounts of group II oxides (including group II hydroxides and mixtures of these compounds) is from about 0.1 to about 1 or about 2 weight percent, more desirably from about 0.2 or about 0.3 to about 0.7 or about 0.8 weight percent. This can also be expressed as from about 0.5 to about 4.0 phr, preferably from about 1.0 to about 3.0 phr, and most preferably from about 1.5 to about 2.5 phr. Specific preferred compounds include magnesium oxide, or magnesium hydroxide or calcium oxide. Examples of suitable magnesium oxide additives are 99% pure magnesium oxide sold under the trade name "Elastomag" from Morton Thiokol, Inc. in Danvers, Mass. Other examples include a magnesium oxide dispersion sold under the trade name "PG-9033" by Plasticolors, and a magnesium hydroxide dispersion also sold by Plasticolors under the trade name "PG-91146". Another suitable magnesium hydroxide is Barcroft, which is a powdered version. Fumed silica could be used at from about 0.5 to about 20 phr, preferably from about 1 to 10 phr.

Other components to the molding composition include flame retardants such as decabromo flame retardants for example one sold under the tradename FR-1210 by Durr Marketing, used in the range of from about 5 to about 20 phr, and more preferably in the range of from about 7.5 to about 15 phr, and most preferably in the range of about 10 to about 15 phr. This can advantageously be combined with a synergist such as antimony trioxide such as SB203 sold by Durr Marketing and used in the range of from about 0.5 to about 10 phr, and preferably from about 1 to about 7.5 phr, and more preferably from about 3 to about 6 phr.

The composition also includes flexibilizing agents; mold release agents; polymerization inhibitors to inhibit premature polymerization during storage or the initial stages of molding; viscosity modifiers like fumed silica; and mold lubricant like stearates of calcium, zinc or magnesium.

In addition, shrink control additives can advantageously be added to improve the surface characteristics and the dimensional stability of the resulting products. These shrink control additives include "anti-shrink" and "low profile additives" as part of this aspect of the invention. These additives generally include thermoplastics or elastomerics such as homopolymers of ethylene, styrene, vinyl toluene, alkyl methacrylates, polyethylene ether, polyphenylene oxide and alkyl acrylates. Additional examples include copolymers using the foregoing and in addition, vinyl chloride, vinyl acetate, acrylonitrile, and butadiene. In particular these co-polymers would advantageously include copolymers of vinyl chloride and vinyl acetate; styrene and acrylonitrile; methyl methacrylate and alkyl esters of acrylic acid; methyl methacrylate and styrene; methyl methacrylate and acrylamide; and SBS block copolymers. Particularly advantageous additives are thermoplastics, with saturated polyesters being preferred among these. These additives are generally used in the range of 10 to 50 weight percent based on the total weight of the additive and the resin system, i.e. the resin and any monomers. More preferably this range would be 20 to 45 weight percent, with a particularly preferred range of about 30 to 40 weight percent. These additives are usually added with the resin blending. As necessary the cure system may be adjusted to compensate for the presence of the additive.

The molding compositions may be formulated and mixed using a variety of mixing conditions including either continuous or batch and using a variety of known mixing equipment. Specific examples are set forth in the example section. The compositions may be advantageously stored for reasonable times before molding. The compositions can be molded by a variety of methods including compression, transfer, and injection molding or combinations of theses techniques. The compositions can be molded under typical conditions for these types of molding including at pressures from about 400 to about 9000 psi, and preferably from about 2000 to about 3500 psi, and most preferably from about 2500 to about 3000 psi and temperatures at from about 225 to about 400 degrees Fahrenheit. Dwell times are from about 10 seconds to about four minutes.

Otherwise conventional injection molding techniques apply as is discussed for example in U.S. Parent No. 6,365,069 B2 incorporated by reference herein. It is preferable to avoid temperature variations at the mold level. At normal cure rates, the dwell time for injection molding is typically around 5 to 600 seconds, or more usually 30 to 300 seconds or around one or two minutes. The process can be practiced for single or double gate cavity tools, or even for injection/compression processes in which the mold is slightly opened during fill and the mold is shut to compress the shot.

The articles from the composition desirably have tensile strength from about 2000 to about 6000 psi as measured in accordance with ASTM test No. D638 and flexural modulus from about 3000 to about 10,000 psi when tested in accordance with ASTM test no. D790.

Molded products made from the compositions of the present invention are useful for a variety of applications demanding complex configurations, as well as strength, and corrosion resistance. One particularly advantageous product, which can be made by compression molding, is a blower housing shown in FIGS. 1 and 2. The housing is typically molded in two parts and fitted together.

The following compositions are examples of ingredients that could be used in the composition of the present composition: Suitable resins may include, but not be limited to the following: Hetron 922 is available from Ashland Chemical Co in Columbus Ohio. It is a low viscosity epoxy vinyl ester resin. It is about 55 wt. % solids and about 45 wt. % reactive monomer. Atlac 382ES is a resin from Reichhold Chemicals, Inc. in Research Triangle Park, N.C. It is characterized as a bisphenol fumarate resin. It is diluted to about 55 wt. % solids with styrene. Dion 6694 is a resin diluted to 55 wt. % solids in styrene. It is available from Reichhold Chemicals, Inc. It is characterized as a modified bisphenol fumarate polyester. Resin 42-2641 is available from Cook Composites and Polymers in Kansas City, Mo. It is diluted to 55 wt. % solids with styrene. It is characterized as an unsaturated polyester resin. ATLAC 3581-61 is sold by Reichhold Chemicals, Inc. It is characterized as a vinyl ester resin at 19 wt %, polyester at 27 wt % and urethane polymer at 4 wt % combined with 50 wt % styrene. Thus, it is diluted to 50 wt % solids with styrene. 580-05 is a resin from Reichhold Chemicals, Inc. It is characterized as a urethane-modified vinyl ester resin. It is diluted to 54 wt % solids with styrene. 9100 is a resin from Reichhold Chemicals, Inc. It is characterized as a bisphenol-epoxy vinyl ester. It is diluted to 54-58 wt % solids with styrene. Dow Derakane R8084 from Dow Chemicals, Inc. It is characterized as an elastomer-modified vinyl ester resin. It is diluted to 50-60 wt % solids with styrene. 9480-00 from is from Reichhold Chemicals, Inc. It is characterized as an epoxy novolac vinyl ester. It is diluted to 53.5 wt % solids with styrene.

31632 is from Reichhold Chemicals, Inc. It is characterized as a isocyanurate vinyl ester resin with 4 wt % polyether polyol. It is diluted to 60 wt % solids with styrene. Dow Derakane 797 from Dow Chemicals, Inc. It is characterized as a one pack resin which is an epoxy vinyl ester resin containing 7-13 weight percent of divinyl benzene, 5-15 weight percent of styrene butadiene rubber co-polymer, 2-6 weight percent of styrene homopolymer, and 0.5 to 1.5 weight percent of styrene-ethylene oxide block copolymer, as a low profile additive. It is diluted to 60-65 wt % solids with styrene. Dow Derakane 790 from Dow Chemicals, Inc. It is also characterized as a one pack resin which is an epoxy vinyl ester resin containing 5-15 weight percent of styrene butadiene rubber co-polymer, 2-6 weight percent of styrene homopolymer, and 0.5 to 1.5 weight percent of styrene-ethylene oxide block copolymer, as a low profile additive. It is diluted to 50-60 wt % solids with styrene. 31633-00 from Reichhold Chemicals, Inc. It is characterized as a isocyanurate vinyl ester resin with 4 wt % polyether polyol. It is diluted to 60 wt % solids with styrene. Derakane 780 is from Dow Chemicals, Inc. It is also characterized as a vinyl ester resin. It is diluted to 60-70 wt % solids with styrene. Polylite is from Reichhold Chemicals, Inc. Altac-G380 is from Reichhold Chemicals, Inc. Derakane 790 from Dow Chemicals, Inc.

These resins can be combined with monomers, such as styrene, or Divinylbenzene HP from the Dow Chemical Company and characterized as 80 wt % divinyl benzene, 18 wt % ethylvinylbenzene, less than 0.12 wt % p-tert butylcatechol, less than 0.5 wt % diethylbenzene and less than 1 wt % of Naphthalene.

In addition, rheological modifiers can be used and include Elastomag from Morton Thiokol. Inc. in Danvers, Mass. It is characterized as 99% pure magnesium oxide. The modifiers could also include FN-510, a linear low-density polyethylene from Equistar Chemicals, L.P. of Houston, Tex. and fumed silica, such as Cab-o-sil silica.

Suitable initiators include Vazo (2,2-azo bisisobutyronitrile) available from Dupont, I & B Industrial and Biochemical Dept, Wilmington Del., tert-butyl peroxy isopropyl carbonate (Triginox BPIC) available from Durr Marketing in Pittsburgh, Pa., t-butylperbenzoate (TBPB) available from Durr Marketing, and 1,3 di-t-butyl peroxy-3,5,5 trimethylcyclohexane catalyst (Trig 29B75) available from Durr Marketing.

Calcium stearate and zinc stearate sold as COAD 27 by the Norac Company, Incorporated of Azusa, Calif. can be used as mold release agents, as can Tech-Lube HV-706, which is a proprietary composition of fatty acids, glycerides, polymeric resin and phosphate surfactant.

EXAMPLES

Resin A is 31610 styrene solution of an unsaturated polyester resin based on propylene glycol and isophthalic acid and maleic anhydride sold by Reichhold.

Monomer A is styrene.

R-100 is a polystyrene solution which acts as a low shrink additive?

These ingredients are added together to comprise the base resin for 100 phr.

Flame retardant A is FR-121-(DBDPO).

Synergist A is Antimony Trioxide.

Flow modifier A is FN-510, a linear low-density polyethylene from Equistar Chemicals, L.P. of Houston, Tex.

Initiator A is Trigonox. C, an alkylperoxyester (t-butylperbenzoate) available from Durr Marketing in Pittsburgh, Pa.

Initiator B is Trigonox 210P50 an alkylperoxyester (tert-Butyl peroxy-2-ethylhexanoate available from Durr Marketing in Pittsburgh, Pa.

Initiator C is Trigonox BPIC-C75 Tert-butyl peroxy isopropyl carbonate from Durr Marketing in Pittsburgh, Pa.

Inhibitor A is IN-9073 is Toluhydroquinone in Diethylene Glycol from Plasticolors.

Inhibitor B is IN-91039 is 5% Parabenzoquinone in DAP.

Mold release agent A is Zinc stearate from Norac.

Thickener A is PG-91048 is a mag oxide dispersion from Plasticolors.

Aluminum Trihydrate A is SB-222 a medium particle size ATH.

Aluminum Trihydrate B is SB-432 a unique particle size distribution ATH having a closely controlled top size with a large super fine faction.

Glass fibers used is PPG 5509 (16 micron) continuous strand glass roving with silane size.

The molding compositions are generally prepared by adding the resin, monomer, initiator, inhibitor, mold release agent, and rheological modifier (if present) to a high shear cowls disperser to form a paste. The paste is then applied to two carrier films to form a sandwich layer with the glass fibers in the middle. The paste viscosity is in the range of 10,000 to 40,000 cps, with the paste temperatures in the range of 38° C. to 49° C. The compound is allowed to thicken or mature, normally 2 to 5 days the to reach a viscosity of about $20\times10^6$ to about $30\times10^6$ cps. FIG. 3 illustrates a SMC machine 300 which is suitable for use in compounding the material in accordance with the present invention. In particular, paste 302 is transferred into SMC machine doctor boxes 304 along with glass rovings 306 which are fed through chopper blades 310 along with the paste and subsequently sandwiched between two layers of carrier film 308. This is compacted between compaction rollers 312 and monitored with a gamma gauge 314 in order to produce the desired thickness of product.

After maturing the compound can be molded in a number of various methods compression molding, injection molding, injection compression molding, and transfer molding. Molding temperatures can vary from 140° C. to 160° C. and molding dwell times can be from 1 to 6 minutes. Molding pressues can vary from 500 psi to 3000 psi.

Figure 4:
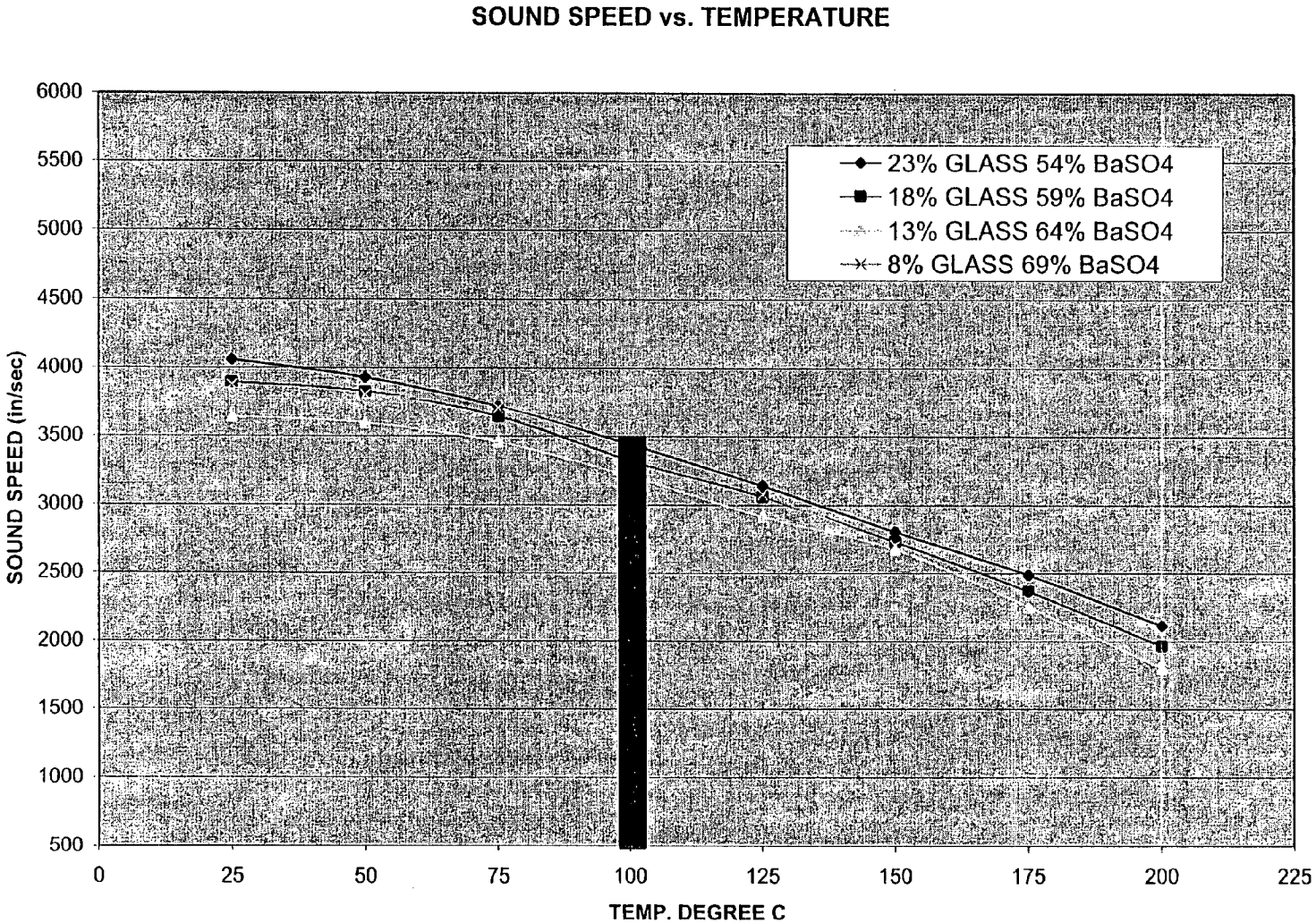
FIG. 4 is a graph of Sound Speed versus Temperature for various loadings of glass fibers.

FIG. 4 is a graph of sound speed versus temperature showing that it is unexpected to achieve an improved sound dampening at the preferred range of glass fibers.

Table I sets forth recipes of compositions in accordance with the present invention which were tested for molding into blower housings. Ingredients are listed in parts per hundred of resin (PHR).

TABLE I

| | SL-791-B1 | SL-415-C8 |
|---|---|---|
| Resin A | 76.16 | 72.56 |
| Shrink Control Additive | | |
| R-100 | 18.87 | 17.98 |

TABLE I-continued

| | SL-791-B1 | SL-415-C8 |
|---|---|---|
| Monomer A | 4.97 | 9.46 |
| Flow modifier A | 1.66 | 1.58 |
| Initiator A | | 0.79 |
| Initiator B | 0.36 | 0.35 |
| Initiator C | 0.82 | |
| Inhibitor A | | 0.09 |
| Inhibitor B | 0.20 | |
| Carbon Black | 0.17 | |
| Calcium Stearate | 4.64 | 3.15 |
| Al trihydrate A | 101.59 | 93.56 |
| Al trihydrate B | 33.11 | 31.55 |
| Flame retardant A | 8.28 | 7.89 |
| Synergist | 4.14 | 3.94 |
| Mag oxide | 3.31 | 3.15 |
| Glass fibers | 72.85 | 69.40 |

While in accordance with the Patent Statutes, the best mode and preferred embodiment have been set forth, the scope of the invention is not limited thereto, but rather by the scope of the attached claims.

What is claimed is:

1. A method of making a blower housing for an air handler or hot air furnace comprising molding the housing from a composition comprising:

a) an unsaturated prepolymer resin which comprises a polyester isophthlate;

b) an unsaturated material copolymerizable with said resin and including a terminal ethylene group;

c) from about 10 to about 25 percent by weight of glass fiber based upon the total weight of the composition;

d) an initiator to initiate said copolymerization; and e) a flame retardant comprising antimony trioxide which is present in an amount from about 5 parts to about 20 parts by weight based upon 100 parts by weight of resin.

2. A method of making a blower housing as set forth in claim 1 wherein the amount of glass fiber is from about 15 to about 25 percent by weight based upon the total weight of the composition.

3. A method of making a blower housing as set forth in claim 1 wherein the amount of glass fiber is from about 18 to about 23 percent by weight based upon the total weight of the composition.

4. A method of making a blower housing for an air handler or hot air furnace comprising molding the housing from a composition comprising:

a) a polyester isophthlate resin;

b) an unsaturated material copolymerizable with said resin and including a terminal ethylene group;

c) from about 60 to about 75 phr of glass fiber based upon the total weight of the resin which is the weight of a) and b);

d) an initiator to initiate said copolymerization; and e) a flame retardant comprising antimony trioxide which is present in an amount of from about 5 parts to about 20 parts by weight based upon 100 parts by weight of resin.

* * * * *